US011284664B2

(12) United States Patent
Hofbauer

(10) Patent No.: US 11,284,664 B2
(45) Date of Patent: Mar. 29, 2022

(54) FOOTWEAR

(76) Inventor: Thomas J. Hofbauer, Fort Lauderdale, FL (US)

( * ) Notice: Subject to any disclaimer, the term of this patent is extended or adjusted under 35 U.S.C. 154(b) by 0 days.

(21) Appl. No.: 12/880,847

(22) Filed: Sep. 13, 2010

(65) Prior Publication Data

US 2012/0060390 A1 Mar. 15, 2012

(51) Int. Cl.

| | |
|---|---|
| ***A43B 13/18*** | (2006.01) |
| ***A43B 3/10*** | (2006.01) |
| ***A43B 3/12*** | (2006.01) |

(52) U.S. Cl.

CPC ..... *A43B 3/103* (2013.01); *A43B 3/108* (2013.01); *A43B 3/122* (2013.01); *A43B 3/128* (2013.01); *A43B 13/187* (2013.01)

(58) Field of Classification Search

CPC ..... A43B 3/103; A43B 3/108; A43B 3/128; A43B 3/122; A43B 13/187

USPC ..... 36/102, 103, 11.5, 25 R, 31

See application file for complete search history.

(56) References Cited

U.S. PATENT DOCUMENTS

| | | | | |
|---|---|---|---|---|
| 2,481,281 A | | 9/1949 | Bender | |
| 2,517,472 A | | 8/1950 | Fathauer | |
| 2,518,649 A | | 8/1950 | Tydings et al. | |
| 2,758,395 A | * | 8/1956 | Miyaji | 36/11.5 |
| 2,760,279 A | * | 8/1956 | Jones | A43B 3/103 36/11.5 |
| 2,926,435 A | * | 3/1960 | Maling | 36/58.5 |
| 3,290,802 A | * | 12/1966 | Fukuoka | 36/11.5 |
| 3,675,346 A | * | 7/1972 | Miyachi et al. | 36/11.5 |
| 3,757,435 A | * | 9/1973 | Schwartz | A43B 13/38 36/30 R |
| 3,859,727 A | * | 1/1975 | Nakamoto | A43B 7/146 36/11.5 |
| 4,241,523 A | | 12/1980 | Daswick | |
| 4,372,059 A | * | 2/1983 | Ambrose | 36/32 R |
| 4,397,104 A | | 8/1983 | Doak | |
| 4,419,836 A | | 12/1983 | Wong | |
| 4,425,721 A | * | 1/1984 | Spronken | A43B 3/128 36/11.5 |
| 4,573,457 A | * | 3/1986 | Parks | 602/29 |
| 4,852,273 A | * | 8/1989 | Hamy | 36/28 |
| 4,967,750 A | | 11/1990 | Cherniak | |
| 4,972,613 A | | 11/1990 | Loveder | |
| 5,142,797 A | | 9/1992 | Cole, III | |
| 5,335,430 A | | 8/1994 | Fiso et al. | |
| 5,507,106 A | * | 4/1996 | Fox | A43B 13/143 36/103 |
| 5,592,757 A | | 1/1997 | Jackinsky | |
| 5,826,351 A | * | 10/1998 | Tsuji | 36/25 R |
| 6,065,229 A | * | 5/2000 | Wahrheit | 36/25 R |
| 6,237,249 B1 | | 5/2001 | Aguerre | |
| 6,421,935 B1 | | 7/2002 | Bartlett | |
| 6,516,538 B2 | | 2/2003 | Kraft | |
| 6,931,766 B2 | | 8/2005 | Greene | |

(Continued)

*Primary Examiner* — Katharine G Kane

(74) *Attorney, Agent, or Firm* — Fish & Richardson P.C.

(57) ABSTRACT

Improved footwear is disclosed, including an improved foot gripping member and footwear having a resilient and angled or curved sole. The improvements are particularly well adapted for footwear made for beach, street, home, sports, or general casual wear. The various features of the disclosed footwear may be utilized alone, or in combination with each other, in order to improve the comfort and improve the attachment to the footwear to the foot.

7 Claims, 11 Drawing Sheets

(56) References Cited

U.S. PATENT DOCUMENTS

| | | | | |
|---|---|---|---|---|
| 6,993,858 | B2 | 2/2006 | Seamans | |
| 7,028,420 | B2 | 4/2006 | Tonkel | |
| 7,029,552 | B1 | 4/2006 | Bruckner | |
| 7,032,327 | B1 * | 4/2006 | Tartaglia et al. | 36/11.5 |
| 7,284,341 | B2 | 10/2007 | Moseley | |
| 7,439,837 | B2 | 10/2008 | McDonald | |
| 7,552,546 | B2 | 6/2009 | Cockbum | |
| 7,584,553 | B1 * | 9/2009 | Medley | 36/11.5 |
| 7,793,437 | B2 * | 9/2010 | Chapman et al. | 36/88 |
| 2007/0220777 | A1 * | 9/2007 | Richardson | 36/11.5 |
| 2008/0244932 | A1 * | 10/2008 | Nau | 36/102 |

* cited by examiner

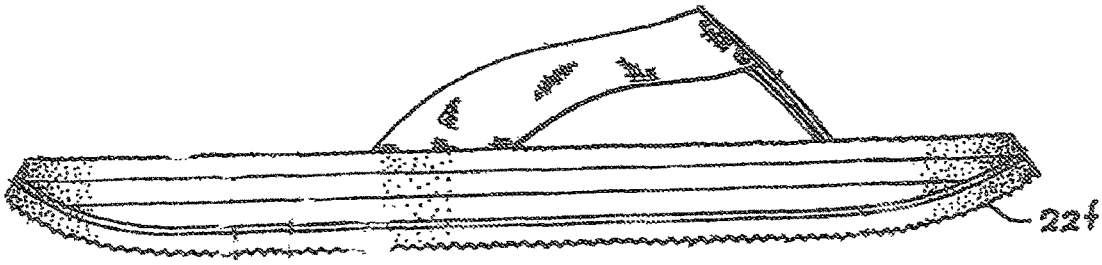
PRIOR ART FIG. 1
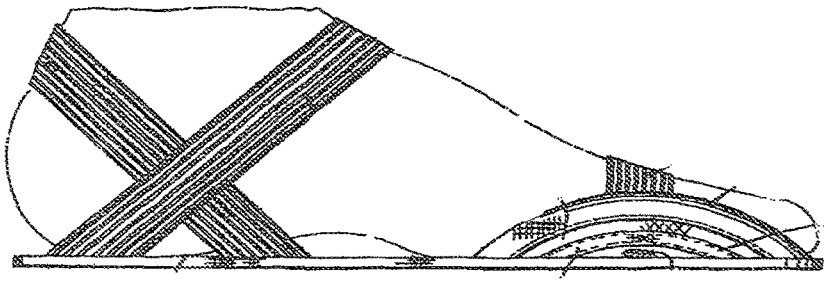
PRIOR ART FIG. 2
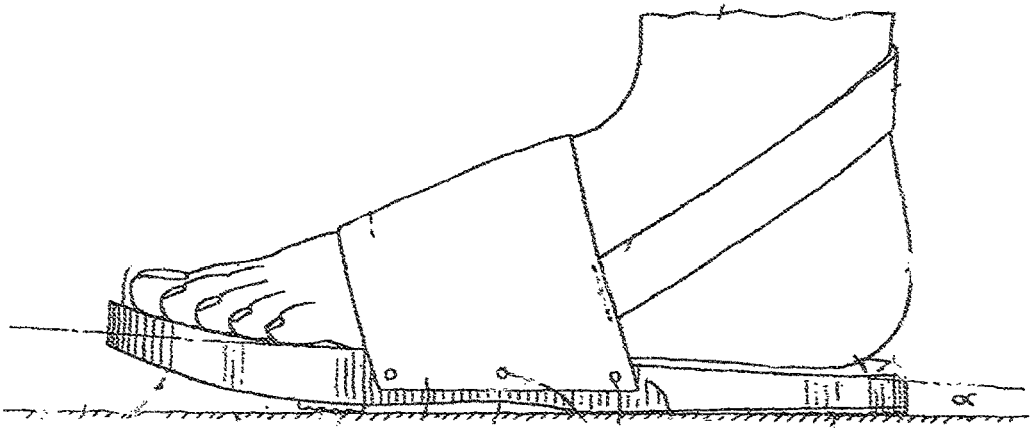
PRIOR ART FIG. 3

FOOTWEAR

TECHNICAL FIELD

This document relates to footwear, and particularly to casual footwear, including sandals, "flip-flops," athletic shoes, slippers, open-heeled footwear, and the like. Concepts and designs are proposed that improve the attachment of the footwear to the foot as well as related concepts and designs to improve footwear comfort, safety, efficiency, fit, convenience, and walking or running characteristics.

BACKGROUND

Presently, a popular design for a casual sandal is typically called a "flip flop." It normally comprises a sole made of plastic, rubber, leather, or similar material, without sides and shaped like a footprint but slightly larger than the foot of the prospective wearer. Typically, a thong connects the sole of the footwear to the foot of the wearer. The thong is usually attached at its forward end to the forward base of the sole where it passes up between the first and second toe, thereafter traveling to the top of the foot where it forks into a left and a right thong strap. One of these straps travels down along the inside of the foot and attaches at or near to the inner edge of the sole, near the arch of the foot. The other strap travels down along the outside of the foot and attaches at or near to the outer edge of the sole, approximately even with the inner strap, laterally, on the opposite side, as shown in prior art FIGS. 6A and 6B. The use of the thong and associated thong straps often fail to adequately secure the sole of the footwear to the foot of the wearer. This loose fitting can be uncomfortable, particularly where the thong and thong straps contact the wearer's foot. The loose fitting can also be dangerous when walking or running.

In addition, little or no provision is made to connect the heel of the footwear to the foot. Therefore, during a walk, as the heel of the rear or trailing foot rotates up, the heel section of the footwear does not follow up. Instead, the heel of the footwear separates from the bottom of the heel of the foot, as hereinafter shown in FIG. 7. This causes wearers to modify their walking style by either dragging or shuffling the flip-flop forward or pushing down hard with their toes to keep their toes engaged with the thong. Depending upon the wearer, this may cause the foot to slide back upon the sole, loosening the foot's connection to the thong. This is hard to control, especially when running and may even become hazardous. It may also cause irritation between the toes where the thong makes contact. Thus, while these designs offer open-heeled footwear that is easy to "slip into," and provide a certain look or accepted style that is simple and inexpensive to make, they come at the expense of comfort, safety, and close fit.

One example of such an open-heeled design can be seen in U.S. Pat. No. 4,419,836, which attempted to provide improvements in walking characteristics by using a curvature in the underside of the forward end or toe region of the sole. The embodiment shown in FIG. 3 of that patent is reproduced here as Prior Art FIG. 1. That patent gives two reasons for the curvature of the forward end surface: (1) "it allows him (the walker) to roll his trailing foot upward, on the slope forward end surface 22*f*, instead of providing a sharp corner." and (2) when walking on wet surfaces "the upwardly sloped lower sandal surface at 22/helps avoid . . . splashing." It does provide an improvement in traction but does not address looseness, comfort, or basic attachment to the foot.

Other prior designs have attempted to use heel straps in order to account for the looseness of fit and the separation of the heel of the sandal from the heel of the foot when walking. To date, designs of sandals, flip flops, and similar footwear presented various features but those that offered good contact between the heel of the foot and heel of the footwear did so typically by including heel straps or heel coverings. This was at the expense of easy access of the foot when putting on the footwear and the additional cost of providing the added attachments.

U.S. Pat. No. 2,481,281 discloses such a prior art footwear design. FIG. 1 of that patent is reproduced here as Prior Art FIG. 2. In consideration of the desire to more fully attach the footwear to the foot, it provides cross-directed, elastic heel straps to maintain the connection of the footwear to the heel of the foot. This does improve the connection to the foot but in particular the heel straps depart from the look and simple design of the flip-flop style and prevent "hands free," "slip on" access.

Other prior art sandal designs have addressed walking characteristics, such as U.S. Pat. No. 2,518,649. FIG. 1 of that patent is reproduced here as Prior Art FIG. 3. This footwear proposes an exercising clog with a "relatively rigid," slanting sole that is "rearward inclined from toe to heel." As described, this is intended for the "treatment of foot ills." For attachment to the foot, it requires a heel strap, but it does not address cost, style, or ease of access.

Still other sandals have been designed to secure the footwear to the heel by using a heel strap, such as U.S. Pat. No. 6,516,538. FIG. 1 of that patent is reproduced here as Prior Art FIG. 4. This sandal is designed for reef and river walking and discloses an elastic heel strap which is adjustable for a tighter fit to the forward part of the thong but not to the heel of the footwear. The addition of heel straps does not allow "slip in/on," "hands off" access and departs from the "flip flop" style.

Still other approaches to aiding the basic attachment to the foot can be seen in the so-called "strapless" sandals, which use an adhesive to stick the footwear onto the wearer's foot. Although these designs, if flexible enough, may cause the sole of a sandal to stick to the foot while walking, they require the use of an adhesive to do so. U.S. Pat. No. 7,029,552 discloses such a prior art design. No drawings are provided in that patent, however the description acknowledges that the adhesive may "lose its tackiness" and would have to be " . . . refreshed . . . by scrubbing it with soap and water" or " . . . reactivated by inserting the sandals in the microwave." In addition, the adhesive does not lend itself to use in many places such as on lawns, over foot trails or, especially, at the beach. Further, the sticky feeling of the adhesive may be undesirable to many users.

U.S. Pat. No. 5,142,797 discloses the use of a resilient material for the soles of shoes. FIG. 2 of that patent is produced here as Prior Art FIG. 5. This patent describes a "negative toe rocker" of the shoe. Further it states that it is designed to provide " . . . mechanical advantage to the wearer in sports . . . ." As revealed in said patent, "[w]hen the wearer of the shoe places weight on the toe portion of the sole the pliable resistance of the sole to flattening results in a tendency for the heel of the wearer to pull outwardly out of the heel of the shoe." Therefore, in such a design a top covering, or "upper", of the shoe with laces and pads are needed to keep the foot of the wearer in place. Thus, the design is intended to provide a mechanical advantage and, in doing so, creates a tendency for the heel of the wearer to pull away from the heel of the shoe.

SUMMARY

This document describes footwear in the general classifications of sandals, athletic footwear, golf shoes, slippers, flip-flops, and the like, that provide improved walking or running characteristics, better fit, comfort, safety, efficiency, and convenience. Preferred embodiments of the footwear disclosed herein are directed toward overcoming one or more of the aforementioned limitations of casual footwear in the general classifications of sandals, athletic footwear, golf shoes slippers, flip-flops and the like, thus creating footwear in all of these categories that provide improved walking or running characteristics, better fit, comfort, safety, efficiency, and convenience. In particular, embodiments are disclosed that reduce or eliminate the tendency of the sole of the footwear to separate from the foot when walking or running, essentially without sacrificing or departing from the outward appearance, style, and advantages of conventional flip-flops, sandals or similar footwear.

It is an object of certain preferred embodiments to provide improved casual footwear, such as athletic footwear, sandals, flip-flops, slippers and the like that maintain substantially continuous contact between the heel of the footwear and the heel of the foot when in use, and generally maintain the accepted utility, style, economy, convenience, and appearance of such footwear.

It is an object of preferred embodiments to provide improved casual footwear, having an open top, open heel structure without heel straps or heel covers, that provide easy access or "slip in" entry while still maintaining substantially continuous contact between the heel of the footwear and the heel of the foot when walking or running.

It is an object of preferred embodiments to provide an improved sole for said casual footwear made to an angled or curved form or shape and of an enduring material that has elastic or resilient properties that enable the angle to straighten or flatten when under pressure by the foot of a wearer and flex back to its original shape when pressure is relieved.

It is an object of certain preferred embodiments to provide improved designs having the look and simplicity of such casual footwear as flip-flops, that can be manufactured at a comparable cost and having an open top thong style, and with an improved angled, curved or shaped sole which is essentially upwardly concave or angled on the upper surface and has the added resilient capability of alternately flattening when foot pressure is applied simultaneously to both the fore portion and the aft portion of the sole and then flexing back toward its original shape or angle as pressure is relieved from the aft portion of the sole as the heel of the foot rises or angles up when walking.

It is also an object of preferred embodiments to provide footwear, such as a sandal or flip-flop, comprising a sole and a thong, or mid-foot band or "upper," that maintains substantially continuous contact between the sole of the footwear and the heel of the wearer's foot (i.e., sole-to-heel contact) while walking or running, without incorporating heel straps or similar devices, thereby permitting unassisted easy access for the foot to enter from the rear of the sandal.

It is an object of certain embodiments to provide footwear, such as a sandal or flip-flop, comprising a sole and a thong, or mid-foot band or upper that maintains substantially continuous sole to heel contact while walking or running, without incorporating heel straps, thong straps or similar devices, thereby permitting unassisted easy access for the foot to enter from the rear of the footwear.

It is also an object of certain preferred embodiments to provide footwear, such as a sandal or flip-flop, comprising a sole and a thong that maintains substantially continuous sole-to-heel contact while walking or running, by providing a gripping member without incorporating thong straps, heel straps, foot bands, or uppers, thereby providing an even more open design and permitting unassisted easy access for the foot to enter from the rear of the footwear.

It is an object of certain preferred embodiments to provide designs for various types of footwear, including sandals, flip-flops, slippers and the like that maintain continuous or substantially continuous sole-to-heel contact primarily from the shape or form and a proper balance of the elastic, resilience, flexible and strength properties of the sole.

It is an object of certain preferred embodiments to provide designs for various types of footwear, including sandals, flip-flops, slippers and the like that reduce or eliminate the tendency of the sole of the footwear to separate from the foot primarily by providing the proper angle, shape or form and a proper balance of the elastic, resilient, flexible and strength properties of the sole.

It is an object of preferred embodiments to provide designs for casual footwear, such as sandals, flip-flops, slippers and the like that are comfortable and maintain a good fit both while at rest, while walking, and/or while running.

It is an object of certain embodiment to provide designs for casual footwear, such as sandals, flip-flops, slippers, athletic shoes, sneakers, golf shoes, golf sandals and the like that have angled soles with elastic, resilient, flexible and strength qualities that are fundamental to the sole material.

It is an object of other embodiments to provide casual footwear, such as sandals, flip-flops, slippers, athletic shoes, sneakers, golf shoes, golf sandals, and the like that have soles that derive some or all of their form or angularity and/or elastic or resilient qualities from an insert within or an attachment to the exterior of the sole.

It is an object of certain embodiments to provide sports or athletic footwear incorporating angled or shaped inserts for the soles of footwear that incorporate, for example, resilient, elastic, stiffness and strength qualities for enhancing the efficiency, fit, function, comfort, and endurance qualities of sports or athletic footwear.

It is an object of certain embodiments to provide casual footwear, such as sandals, flip-flops, slippers, athletic footwear and the like that combine other known enhancements, such as cleats or elastic sections in all or part of the thong, thong straps, mid-foot upper foot bands or straps, heel straps and the like, to aid one or more of the embodiments of the present invention in fit, function and/or the connection of the sole of the footwear to the heel of the foot.

Objects will generally be achieved by preferred embodiments of the present invention (described below), which provide substantial improvements in casual footwear typically classified as sandals, flip-flops, slippers, athletic footwear and the like that are convenient, economical, comfortable and maintain substantially continuous contact between the heel of the footwear and the heel of the foot while in use.

Objects will generally be achieved by preferred embodiments of the present invention, which provide substantial improvements in casual footwear typically classified as sandals, flip-flops, slippers, sports footwear and the like that are convenient, economical, comfortable and maintain substantially continuous contact between the heel of the footwear and the heel of the foot while walking or running.

Objects will generally be achieved by embodiments for casual footwear typically classified as sandals, flip-flops, slippers, sports footwear and the like that are convenient, economical, comfortable and reduce or eliminate the tendency of the sole of the footwear to separate from the wearer's foot when walking or running.

Further objects will generally be achieved by embodiments for an improved footwear sole that can be made or formed having an original or natural shape with front portion angled or curved upwards relative to the remaining portions of the sole and where the improved sole is made of a material that has elastic or resilient properties that enable the angle or curve to be reduced, straightened or flattened when foot pressure is applied simultaneously to both the fore portion and the aft portion of the sole and then flex back toward its original shape or angle when pressure is relieved from the aft portion of the sole as the heel of the foot rises or angles up when walking.

Further objects will generally be achieved by embodiments for casual footwear having an open-heel, open-top thong or mid-foot upper band type structure without heel covers or heel straps, allowing "slip on" entry and further having a sole with the necessary properties such as flexibility and resiliency and formed with an upwardly open bend or angle along an axis that approximates the hinging of a foot between the forefoot and mid-foot, such that when the foot exerts pressure or a force on both the fore and aft portions of the sole, it opens the obtuse angle or straightens the sole of the footwear and as the forefoot maintains pressure on the fore portion of the sole while the heel relieves pressure on the aft portion of the sole when the foot rises up while walking, the heel portion of the sole of the footwear also rises, staying substantially in contact with, or close to, the heel of the foot.

Further objects will generally be achieved by embodiments for casual footwear having an open-heel, open-top thong structure without thong straps connecting the thong to the sides of the sole, and without heel covers or heel straps or the like, allowing "slip on" entry and further having a sole with the necessary properties such as flexibility and resiliency and having an original shape with a bend or angle along an axis that approximates the hinging of a foot between the forefoot and mid-foot, such that when the foot exerts pressure or a force on both the fore and aft portions of the sole, it opens the obtuse angle or straightens the sole of the footwear and as the forefoot maintains pressure on the fore portion of the sole while the heel relieves pressure on the aft portion of the sole when the foot rises up while walking, the heel portion of the sole of the footwear also rises, staying substantially in contact with, or close to, the heel of the foot.

Further objects will generally be achieved by embodiments for improved footwear, with the look and simplicity of popular styles such as flip-flops, that can be manufactured at a comparable cost and having an open-top thong configuration and without heel straps, and with an improved angled sole that has the resilient capability of alternately flattening or straightening and flexing back to follow the heel of the foot as it angles up while walking.

Further objects will generally be achieved by embodiments for a sandal or flip-flop, comprising a thong or like upper attaching device and an angled, flexible and resilient sole that maintains substantially continuous sole-to-heel contact while walking or running and does not incorporate a heel strap, heel cover, or upper cover or similar device, thereby also permitting unassisted easy access for the foot to enter from the rear.

Further objects will generally be achieved by embodiments for a sandal or flip-flop, comprising a thong without thong straps and an angled, or curved, flexible and resilient sole that substantially maintains continuous or substantially continuous, sole-to-heel contact while walking or running, without incorporating additional attaching devices, such as heel straps, heel covers or upper covers or similar devices, thereby providing an even more open design and also permitting unassisted easy access for the foot to enter from the rear.

Further objects will generally be achieved by embodiments for footwear, including sandals, flip-flops, slippers, athletic footwear, golf sandals and the like that maintain substantially continuous sole-to-heel contact during use primarily from the form or shape and the elastic or resilient properties of the sole.

Further objects will generally be achieved by embodiments for footwear, such as sandals, flip-flops, slippers, athletic footwear, golf sandals and the like that have flexible, angled, resilient soles that provide a close and comfortable fit, both while at rest and while walking.

Further objects will generally be achieved by embodiments for footwear, such as sandals, flip-flops, sneakers, slippers, athletic footwear, golf sandals and the like that have flexible, angled, resilient soles with inherent elastic and/or resilient qualities basic to the sole material.

Further objects will generally be achieved by embodiments for footwear, such as sandals, flip-flops, sneakers, running shoes, slippers, athletic footwear, golf sandals and the like that have angled soles with elastic or resilient qualities that are derived in part or entirely from an insert within the sole or an attachment to the sole.

Further objects will generally be achieved by embodiments for casual footwear, such as sandals, flip-flops, slippers, athletic footwear, golf sandals and the like that have flexible, angled soles, with thongs not having thong straps attached, which have elastic or resilient qualities that are derived in part or entirely from an angled and/or curved, "C-shaped" or similarly shaped insert anchored within the sole and rising within the thong of the footwear then extending to the top of the foot and gripping or holding the foot to the sole of the footwear. If the sole is not initially sufficiently angled and resilient, this insert may also provide the necessary angle or bend for the sole and the resilience necessary to cause the heel portion of the sole of the footwear to follow the heel of the foot up as it rises while walking.

Further objects will generally be achieved by embodiments for casual footwear, such as sandals, flip-flops, slippers, athletic footwear, golf sandals and the like that have flexible, resilient angled soles, with thongs, but without thong straps that connect the thong to each side of the sole, and have resilient qualities that are derived in part or entirely from an angled, curved, "C" shaped or similarly shaped resilient insert within the sole and thong of the footwear.

Further objects will generally be achieved by embodiments for casual footwear, such as sandals, flip-flops, slippers, athletic footwear, golf sandals and the like that have an angled, flexible, resilient sole with a foot-gripping insert which is anchored within the sole below the emergence point of the thong, within the front or fore portion of the sole and travels up into the thong between the first and second toes and then bends back along the top of the foot where it may terminate or optionally continue and separate into two arms or tabs which extend along each side of the foot and then terminate, without reaching, nor being attached to the sides (or edges) of the sole of the footwear.

Further objects will generally be achieved by embodiments for casual footwear, such as sandals, flip-flops, slippers, athletic footwear, golf sandals and the like that have a foot-gripping insert or attachment which is anchored within or to the sole and travels up into the thong between the first and second toes and then bends back along the top of the foot where it may terminate or optionally continue and separate into two arms or tabs which extend along each side of the foot and then terminate, without reaching, nor being attached to the sides (or edges) of the sole of the footwear.

Further objects will generally be achieved by embodiments for casual footwear, such as sandals, flip-flops, slippers, athletic footwear, golf sandals and the like, with angled, flexible and resilient soles each having a flexible and resilient foot-gripping insert which is anchored within the sole and connects to and enters the thong, rising within the thong at a location between the first and second toes then curving or bending back along the top of the foot where it may terminate or optionally continue and separate into two arms or tabs extending over each side of the foot and then terminate without reaching, nor being attached to or near the sides of the sole of the footwear.

Further objects will generally be achieved by embodiments for casual footwear, such as sandals, flip-flops, slippers, athletic footwear, golf sandals and the like with flexible soles each having an angled, flexible and resilient foot-gripping insert which is anchored within the sole within the relatively flat aft portion of the sole, then angling up into the fore-portion of the sole and entering the thong, rising within the thong at a location between the first and second toes then curving or bending back along the top of the foot where it may terminate or optionally continue and separate into two arms or tabs extending over each side of the foot and then terminate without reaching, nor being attached to the sides (or edges) of the sole of the footwear. If the sole is not initially sufficiently angled and resilient, the insert may also provide the necessary angle and resilience.

Further objects will generally be achieved by embodiments for footwear, such as sandals, flip-flops, slippers, athletic footwear, such as golf sandals or shoes, sneakers or running shoes and the like, that have an angled, resilient sole that provides a close and comfortable fit, both while at rest and while walking or running, such footwear being independent of but able to act in conjunction with other known attaching devices such as heel straps, heel covers, upper covers, foot covers, and the like.

Further objects will generally be achieved by embodiments for footwear, such as sandals, flip-flops, slippers, athletic footwear, golf sandals or shoes and the like that combine one or more of the embodiments of the present invention, with elastic sections that stretch or contract, in all or part of the thong or the thong straps to aid in the contact of the sole of the footwear with the heel of the foot, and/or aid in comfort and fit.

Further objects will generally be achieved by embodiments for footwear, such as sandals, flip-flops, slippers athletic footwear, golf sandals or shoes and the like that combine one or more of the embodiments of the present invention, with other known enhancements such as heel covers, heel straps, foot bands or elastic sections in all or part of the thong or the thong straps, to aid in the contact or connection of the sole of the footwear with the heel of the foot, and/or improve comfort and fit.

Further objects will generally be achieved by embodiments for athletic footwear, such as hiking sandals, wading sandals and in particular golf sandals and the like that utilize one or more of the embodiments of the present invention having cleats attached to the lower surface of the sole.

Objects will be achieved by providing casual footwear including a resilient sole having an initial shape where a fore portion of the sole is upwardly inclined relative to the horizontal plane of an aft portion of the sole, and a means for securing the forefoot of the wearer's foot to the fore portion of the sole, wherein the resilient sole is adapted to flatten when compressed and return to its initial shape when uncompressed. Objects will be achieved by providing such casual footwear wherein the resiliency and initial shape of the sole are substantially provided by a resilient insert member that is adapted to be inserted into the sole. Objects will be achieved by further providing that the resiliency and initial shape of the sole are substantially provided by an external resilient and angled member attached to the sole. Objects will be achieved by providing such footwear wherein the fore portion of the sole is upwardly inclined relative to the horizontal plane of the aft portion of the sole at an angle of more than about 30 degrees and less than about 90 degrees, and further objects will be achieved with an angle of about 45 degrees.

Further objects will be achieved by providing footwear with a resilient curved or angled sole with cleats disposed on the bottom of the sole. Further objects will be achieve by providing such footwear without any heel straps.

Objects will be achieved by providing casual footwear including: a resilient sole having a top surface, a fore portion and an aft portion which is further divided into a mid-section and a heel section; a thong connected to the sole substantially within the fore portion; thong straps connected to the thong and substantially within the mid section of the sole; wherein the thong and thong straps are disposed to form a foot receptacle above the top surface of the sole; wherein the resilient sole has an initial shape where the fore portion is disposed upward to form an obtuse angle between the top surface of the fore portion and the top surface of the aft portion; and wherein the resilient sole is capable of substantially flattening when compressed and returning to its initial shape when uncompressed. Further objects will be achieved by such footwear wherein the resiliency and initial shape of the sole are substantially provided by a resilient insert member that is adapted to reside in the sole, or by an external resilient member attached to the sole. Further objects will be achieved by providing such footwear wherein the obtuse angle is less than about 150 degrees, and further objects will be achieved with an obtuse angle of about 135 degrees. Further objects will be achieved by providing such footwear with cleats disposed on the bottom of the sole and further objects will be achieve by providing such footwear without any heel straps.

Objects will be achieved by providing a sandal including: a resilient sole having a top surface, a fore portion and an aft portion which is further divided into a mid-section and a heel section, and an initial shape where the fore portion of the sole is upwardly inclined relative to the horizontal plane of the aft portion of the sole; a gripping member comprising a first portion disposed within the sole and a second portion that protrudes through and extends above the top surface of the sole. Further objects will be achieved by providing such a sandal wherein the first portion of the gripping member extends within the fore portion of the sole and the mid-section of the sole and is resilient, and has an angled initial shape adapted to provide an upwardly obtuse angle between the fore portion of sole relative to the aft portion of the sole. Further objects will be achieved by providing such a sandal wherein the first portion of the gripping member extends within the aft portion of the sole. Further objects will be achieved by providing such a sandal wherein the second portion of the gripping member is adapted to extend upward from the sole between the first toe and second toe of the wearer's foot. Further objects will be achieved by providing such a sandal wherein the second portion of the gripping member is adapted to extend over a top portion of the wearer's foot. Further objects will be achieved by providing such a sandal wherein the second portion of the gripping member further comprises two connecting members disposed to extend over the user's foot and connect to the sole at opposite sides of the foot. Further objects will be achieved by providing such a sandal wherein the second portion of the gripping member ends, having a plurality of tabs at its end that terminate above the top surface of the sole. Further objects will be achieved by providing such a sandal wherein the tabs are adapted to extend down or along the side of the wearer's foot and terminate on either side of the foot without connecting to the sole of the footwear. Further objects will be achieved by providing such a sandal wherein the tabs are adjustable. Further objects will be achieved by providing such a sandal wherein the tabs are deformable and adjustable. Further objects will be achieved by providing such a sandal wherein the second portion further comprises a spring loaded hinge adapted to secure the second portion to the wearer's foot. Further objects will be achieved by providing such a sandal wherein the sandal does not have any heel straps. Further objects will be achieved by providing such a sandal wherein the sole further comprises cleats disposed on the bottom of the sole.

Objects will be achieved by providing a sandal including: a sole having a top surface, a fore portion and an aft portion with a mid-section; a gripping member comprising a first portion disposed within the sole and a second portion that protrudes through and extends above the top surface of the sole which is adapted to extend upward from the sole between the first toe and second toe of the wearer's foot; and extend over a top portion of the wearer's foot. Further objects will be achieved by providing such a sandal wherein the second portion of the gripping member ends, having a plurality of tabs at its end that terminate above the top surface of the sole. Further objects will be achieved by providing such a sandal wherein the tabs are adapted to extend down or along the side of the wearer's foot and terminate on either side of the foot without being connected to the sole of the footwear. Further objects will be achieved by providing such a sandal wherein the tabs are adjustable. Further objects will be achieved by providing such a sandal wherein the tabs are deformable and adjustable. Further objects will be achieved by providing such a sandal wherein the second portion further comprises a spring loaded hinge adapted secure the second portion to the wearer's foot. Further objects will be achieved by providing such a sandal wherein the sandal does not have any heel straps. Further objects will be achieved by providing such a sandal wherein the sole further comprises cleats disposed on the bottom of the sole. Further objects will be achieved by providing such a sandal wherein the sole is resilient and has an initial shape where the fore portion of the sole is upwardly inclined relative to the horizontal plane of the aft portion of the sole.

The details of one or more embodiments are set forth in the accompanying drawings and the description below. Other features and advantages will be apparent from the descriptions, drawings and the claims.

DESCRIPTION OF DRAWINGS

FIG. 1 is a side elevation view of a prior art sandal showing a sole with a thong having branching thong straps, which corresponds to FIG. 3 of U.S. Pat. No. 4,419,836.

FIG. 2 is a side elevation view of a sandal with elastic heel straps showing a prior art sandal design, which corresponds to FIG. 1 of U.S. Pat. No. 2,481,281.

FIG. 3 is a side elevation view of a prior art exercise clog showing a foot band and heel strap, which corresponds to FIG. 1 of U.S. Pat. No. 2,518,649.

DETAILED DESCRIPTION

Figure 4:
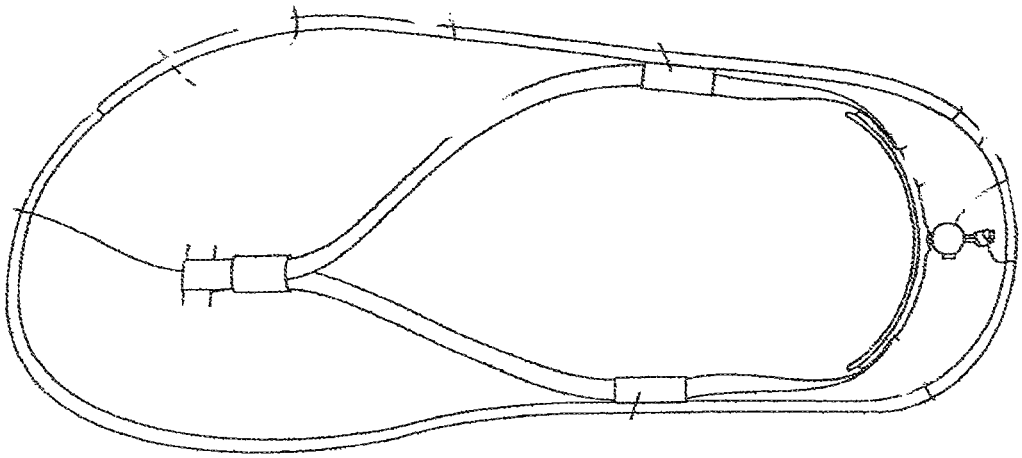
Prior Art FIG. 4
FIG. 4 is a top view of a prior art beach sandal showing a surrounding, adjustable heel strap, which corresponds to FIG. 1 of U.S. Pat. No. 6,516,538.
Figure 5:
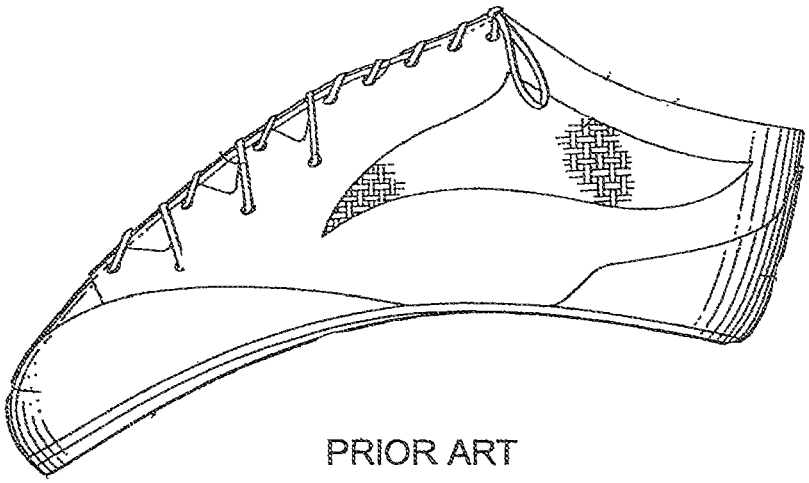
PRIOR ART FIG. 5
FIG. 5 is a side view of a prior art "negative toe rocker" athletic shoe showing the concave curve of the bottom of the sole of the shoe which corresponds to FIG. 2 of U.S. Pat. No. 5,142,797.

Turning now more particularly to the drawings, wherein like numbers refer to like elements, certain representative and non-limiting embodiments of the present invention are shown in FIGS. 8A-18C, with particular emphasis on the angled resilient sole and the angled resilient insert.

It is to be understood and defined as used herein:

The term "sole," when used alone, means the sole or platform of the footwear. When reference is made to the underside of the foot, the phrase "sole of the foot" is used. The term "sole to heel" means "sole of the footwear to heel of the wearer's foot."

The term "heel strap" means any material attached to the sole that is adapted to wrap around the wearer's heel or otherwise secure the wearer's heel to the heel portion of the sole.

The terms "natural angle" and "natural shape" and "initial shape" and "original shape," as used herein, mean the shape or angle of the sole when not worn. Thus, these terms refer to the shape of the sole before forces are applied simultaneously on the fore and aft portions of the sole that together act to straighten or flatten the sole. Such straightening forces are applied, for example, when a user is standing upright, with his feet flat upon the top surface of the sole.

The term "thong" as used herein means a strip of material that is attached to and rises from the front or fore portion of the sole between the wearer's first and second toes. Conventionally, thong straps are connected to the end of the thong and to the sole of the footwear on each side of the foot.

The term "thong strap" as used herein means a length or strip of material that is connected to the end of the thong and also to either side of the sole of the footwear. This may be a distinct piece of material or a continuation of the thong material.

Descriptions of the footwear when mentioned in the singular also refer to the plural since footwear is always considered in pairs.

In one embodiment of the invention, as depicted in FIG. 8A through FIG. 10, the footwear closely resembles the appearance of a conventional "flip-flop" or sandal. In this embodiment, the sole 7 is made out of a flexible material with considerable elastic or resilient properties, including the desired amount of strength and strength and stiffness and fabricated or molded to a significant upwardly angled or curved shape at the fore portion of the sole. The degree of stiffness of the sole or insert material may be increased or decreased to restrict or aid in the flexing action as desired. Typically, the sole 7 will be made out of a relatively soft, durable, light and flexible, elastic, and highly resilient material. Construction may include, e.g., manual or automatic fabrication or molding in one piece or more or other processes known in the art. When not worn, that is, under no pressure from the foot, the initial shape or angle of the sole, as indicated by the angle θ and β, is shown, for example, in FIG. 8B, which depicts a sole that is relatively flat from the heel section 15*b* through the mid-sole section to the angling location 13 at or near where the ball of the foot would rest. At that point it angles or turns up like a hinge toward the toe of the sole 7. The amount of upward deflection is indicated in FIG. 8B by θ and its complementary obtuse angle β. At the discretion of the designer, this upward turn or bend may be offered in a variety of angles to accommodate a variety of foot sizes, shapes and walking characteristics, not unlike the lengths and widths of shoe dimensions. Preferably, however, the upward turn or bend would be at an angle θ of approximately 30 or more degrees to the horizontal, most preferably at an angle of about 45 degrees. In terms of the complementary obtuse angle β, the preferred angle, is approximately 150 or less degrees, most preferably at an angle of about 135 degrees.

In the preferred embodiment shown in FIGS. 8A through 10, an angled fore portion of the sole is disclosed. It should be noted, however, that in other embodiments the fore portion may be upwardly disposed more gradually, such as a curve similar to the shape of a banana. In the preferred embodiment shown in FIGS. 8A through 10, the axis of the "hinge" associated with the upwardly deflected portion would preferably reside horizontally within the sole and would normally be directed at an angle α of somewhat more than 90 degrees to a vertical, longitudinal, fore and aft, mid-plane of the sole; this direction being taken clockwise from the front on the right sole and counter-clockwise from the front of the left sole. It is intended to be in approximate alignment with the hinging of the forefoot relative to the remaining or aft portion of the foot.

Figure 9:
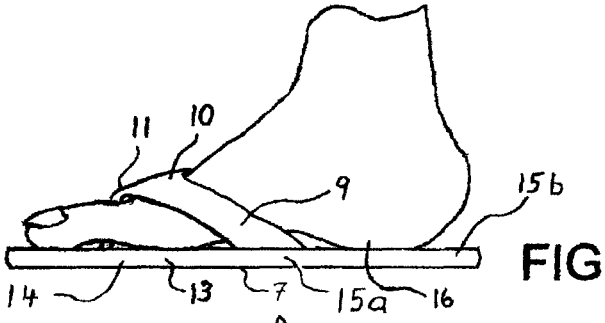
FIG. 9 is a side elevation view of an embodiment of the present invention depicted in FIGS. 8A and 8B, shown in use, and essentially straightened or flattened by the pressure or force exerted simultaneously on the fore and aft portions of the sole by the wearer's foot.
Figure 10:
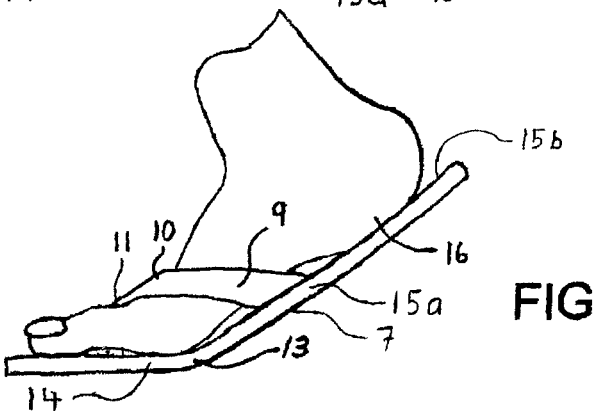
FIG. 10 is a side elevation view of an embodiment of the present invention depicted in FIGS. 8A, 8B and 9, shown in use on the trailing foot during a walk. As the fore-portion 14 of the sole 7 is held down by the forefoot, the heel 15*b* of the sole 7 of the sandal is shown rising with the heel of the foot 16 while the sole 7 tends to return to its natural angle, indicated by θ and β, shown above in FIG. 8B.

FIG. 9 depicts this embodiment of the present invention when in use showing the sole 7 flattened or straightened by the pressure or force applied simultaneously on the fore portion of the sole and the aft portion of the sole by the foot of the wearer FIG. 10 depicts this embodiment of the present invention in the position of the trailing foot during walking, as the heel 16 of the foot angles up. In this condition pressure is applied by the forefoot on the fore portion 14 of sole 7 while pressure is relieved from the heel section 15*b* of the sole 7 causing the sole 7 to flex back toward its natural shape thus maintaining continuous, or substantially continuous, contact between the heel of the sole 15*b* and the heel of the foot 16.

It should also be noted that in other embodiments it may be desirable to provide a thong with elastic qualities, in the forward part of the thong 11, thong straps 8 and 9 or both, sufficient to accommodate (or assist) the need for stretch or "give" as the foot bends during walking. In still other embodiments of this invention the pull of the side straps on the heel section may be increased by locating the branching point 10 of the thong higher up on the top of the foot. Further, in other embodiments, the straps 8 and 9 may be affixed to the sole 7 further hack, toward or within the heel section of the sole.

In still other embodiments the fore-sole of the footwear may be secured to the forefoot of the wearer through other securing means known in the art. For example, the forefoot of the wearer could be secured to the fore-sole by a simple strap over all the wearer's toes and/or a loop of material that secures one or more of the wearer's toes to the fore-sole of the footwear. Another example would include a toe-pocket or receptacle, formed by a partial upper connected to the fore-sole and adapted to form a pocket into which the wearer's toes may be inserted. Other examples will be readily apparent to those in the art. Where possible, these known securing means may of course be used alone or in conjunction with a thong, the preferred embodiments of the foot attaching band described below and seen in FIGS. 18A-18C, or the preferred embodiments of the gripping member described below and seen in FIGS. 17A-17F.

Flexible properties of the sole 7 material will allow the sole 7 to effectively flatten out, as depicted in FIG. 9, when under compression by the foot, e.g. standing, or resting the feet on the floor while sitting, etc. Moreover, the resilient properties of the sole 7 enable it to alternately flatten and flex back toward its original shape while walking. That is, the sole 7 straightens or flattens out when directly underfoot and, when the heel of the foot 16 relieves pressure on the heel section 15*b* of the sole as the heel of the foot rises or angles up during walking and while the fore portion 14 of the sole 7 is held down by the forefoot, the sole 7 bends back, as shown in FIG. 10, toward its natural shape or angle as the heel of the sole 15*b* follows the heel of the foot 16. Another advantage of this embodiment is that it is simple, can emulate a conventional flip-flop or sandal and would be relatively easy to manufacture.

Figure 11A:
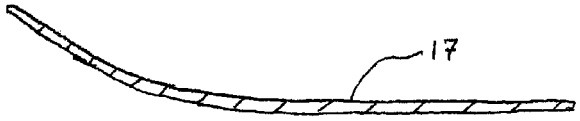
FIG. 11A is a side view of another embodiment of the present invention depicting an angled or curved and resilient insert 17 for the sole which functions to provide the desired angularity and physical properties, such as resiliency, for the composite sole shown below in FIG. 12.
Figure 11B:
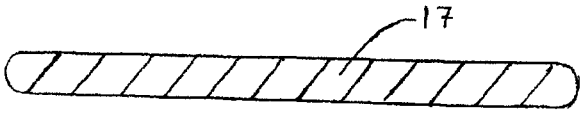
FIG. 11B is a top view of the insert 17 depicted in FIG. 11A.

Another embodiment of this invention is depicted in FIGS. 11A-12A and 13-14. This embodiment includes an angled insert 17, which is shown in FIGS. 11A and 11B. This embodiment of the insert acts to provide some or all of the desired resilient and angular properties of the sole of the footwear and the angle or bend desired for the sole. That is, the insert could provide additional elastic or resilient properties to a flexible angled sole having its own inherent resilient properties or even supply all of the elastic or resilient requirements and angled shape for a sole that may have little or no resilient or elastic characteristics. In one embodiment, seen in FIGS. 12A, 13 and 14, insert 17 and sole 18 are assembled. Before assembling these two elements, the flexible sole 18, itself, may be made similar to a conventional flat flexible sole and obtain its angle or bend and resiliency from the addition of an insert 17, or the flexible sole 18 may be pre-formed with a bend, shape or angle as in the previous embodiment depicted in FIGS. 8A-10 described above, thereafter adding an angled, resilient insert which would share comparable angularity and properties, such as resiliency, with the sole 18. It is also envisaged that the sole 18 in this embodiment may be made with a slot or a slit to accommodate and aid in the installation of the insert 17. For example, the slot or slit could be incorporated in the molding process or added later in a subsequent operation. The insert 17 may be made of a relatively slender strip of flexible and elastic, or spring-like material such as a resilient plastic, rubber, spring steel, other metal or the like that is manufactured with the desired bend, curve or shape, such that, if it were to be flattened or straightened out and released, it would rapidly return to its original shape. In particular, the insert 17 would aid or substitute for some or all of the desired angularity, resilience and elasticity of the flexible sole 18. The shape and relative dimensions of the insert 17 and flexible sole 18, depicted in FIGS. 11A, 11B, 12A, 13 and 14, and their physical properties, such as resilience, elasticity, stiffness, durability, density, strength, etc., may be varied to obtain a wide variety of characteristics. The insert could be molded within the sole or inserted later, depending upon the manufacturing process.

The sole could be made in a variety of ways as known in the art. For example, the sole could be cut out of flexible, flat material and derive its angle and resiliency solely from the insert or it could be made out of flexible and resilient material(s) and fabricated, molded or otherwise formed to the desired angle and shape. Alternatively, a flexible and resilient material could be molded to the desired angle or shape. Another option would be to cut the sole out of a flat material and form the angle or shape in a subsequent operation. Still another option would be to cut or form the sole out of a flat material, make an insertion slot, and install an insert made to provide the desired angular shape and resilient qualities.

The insert could have serrated or tabbed edges to anchor the insert in position after assembly. It could have a variable thickness along its length to increase or decrease characteristics such as strength at certain locations as desired for the application. Although only one particular insert design is shown in the embodiment disclosed in FIGS. 11A and 11B, other shapes or configurations of inserts may also be used. Examples are shown in FIGS. 15A-15E, and it is envisaged that the inserts may be made in a variety of other shapes or forms.

Figure 12A:
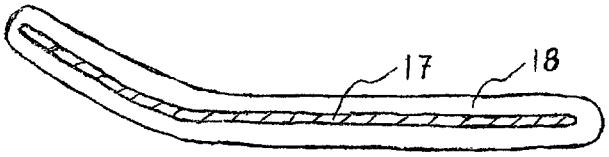
FIG. 12A is a cross-sectional view of the insert 17 depicted in FIGS. 11A and 11B having been inserted into a flexible sole 18 to form another embodiment of the present invention, comprising the angled or curved and resilient insert 17 with the flexible sole 18 of a sandal, flip-flop or similar footwear.
Figure 12B:
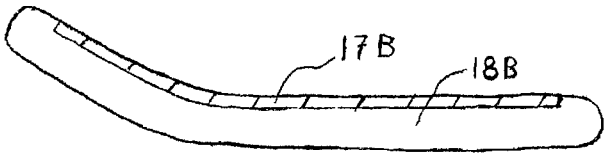
FIG. 12B is a cross-sectional view of an attachment 17B having been affixed or attached to the sole 18B to form another embodiment of the present invention comprising the angled or curved, resilient attachment 17B with the flexible sole 18B of a sandal, flip-flop or similar footwear.
Figure 12C:
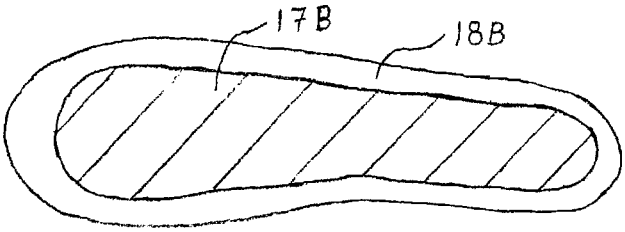
FIG. 12C is a top view of the embodiment of the present invention, shown in FIG. 12B, showing a flexible sole 18B and an angled, resilient, flexible attachment 17B.

Another embodiment of the present invention, which is an alternative to or a variation of the insert, is depicted in FIGS. 12B and 12C which show a comparable resilient, angled attachment 17B applied to the exterior of the sole, in this case on the top surface of the sole, to act as or function as an insert, not within the sole, however, but on the sole. FIGS. 12B and 12C show the attachment affixed to the top surface of sole 18B but the attachment would readily function in the same manner if affixed to the bottom surface of the sole. In such an embodiment the attachment would be made in a convenient shape and dimensioned to easily be attached along the length of the sole on the upper surface or lower surface. The resilient, angled attachment could be molded with or pressed, with or without heat, into either the top or bottom surface of the sole. It could also be attached with adhesives, tabs or anchoring devices similar to those described above. To further enhance its use, a layer of material could be applied over it. That is, the layer would isolate the attachment from the foot of the wearer if it was installed on the top surface of the sole or isolate the attachment from the walking surface if it was installed on the bottom surface of the sole. This attachment may also have anchors such as tabs, ears, bosses or the like to aid in its connection or retention to the sole of the footwear. Recesses or anchoring points may also be provided in the sole to accommodate connecting tabs or the like for attachment. Conversely, the recesses or female anchoring points may be part of the attachment with the anchors or tabs, etc. being part of the sole.

Figure 13:
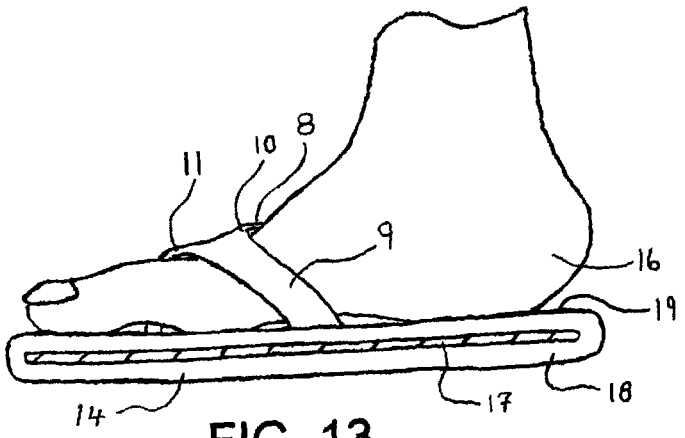
FIG. 13 is a side elevation view of an embodiment of the present invention comprising an assembly of the sole 18 and insert 17, depicted in FIG. 12A, with the addition of a thong having attached branching thong straps 8 and 9. It is shown in use, and essentially straightened or flattened by the force or pressure exerted simultaneously on the fore and aft portions of the sole by the wearer's foot.
Figure 14:
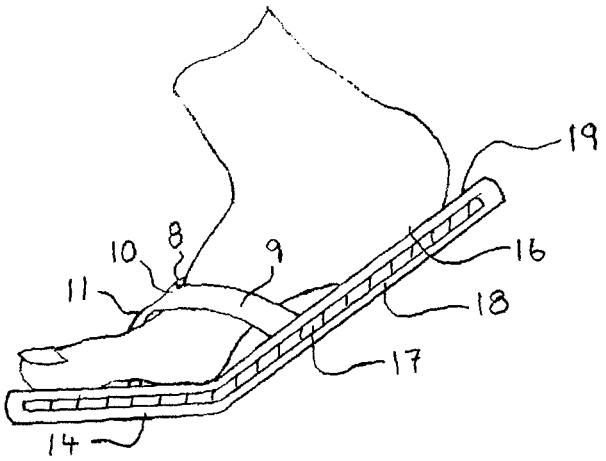
FIG. 14 is a side elevation view of an embodiment of the present invention shown in FIG. 13. Here, the embodiment is shown in use and trailing the wearer's foot during a walk. As the fore portion 14 of the sole 18 is held down by the forefoot, the heel of the sole 19 of the sandal is shown rising with the heel of the foot 16 as it tends to return to the natural angle of the insert, shown above, for example, in FIGS. 11A and 12A.
Figure 15A:
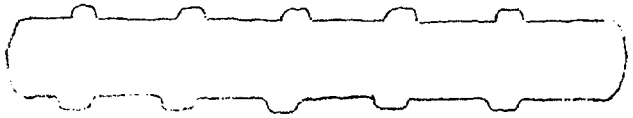
FIG. 15A is a top view of an insert with serrations, tabs or projections to anchor the insert in position after assembly with a basic sole.
Figure 15B:
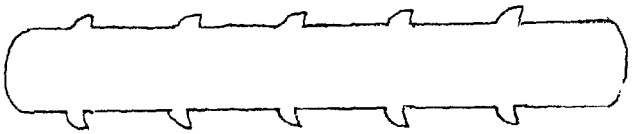
FIG. 15B is a top view of an insert with serrations, tabs or projections biased in one direction to aid in insertion during assembly and inhibit extraction during use.
Figure 15C:
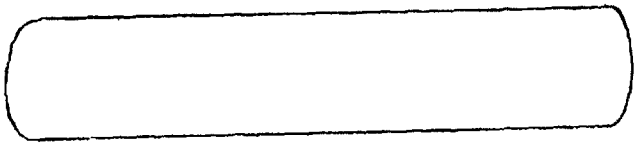
FIG. 15C is a top view of a wider elongated and straight insert, somewhat narrower in width than the heel of the sole and somewhat shorter in length than the length of the sole of the footwear.
Figure 15D:
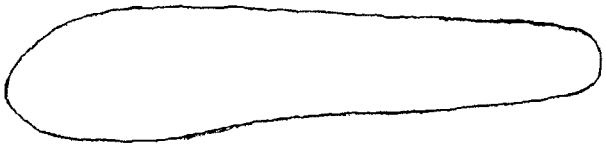
FIG. 15D is a top view of an insert shaped similar to but somewhat smaller than the sole of the footwear.
Figure 15E:
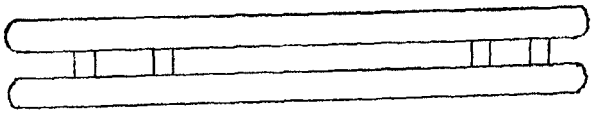
FIG. 15E is a top view of a double or two elongated and connected inserts.

In one embodiment, the sole 18 of this sandal or flip-flop, with the resilient insert 17, installed but without any thong or other foot-securing member, would appear, when not in use, as in FIG. 12A. The basic sole 18 together with the added insert 17 would appear, with a thong 11 and thong straps with inside thong strap 9 and its companion outside strap 8 attached, as in FIG. 13, shown compressed or flattened, for example when the wearer was standing, resting the foot on the floor while sitting, etc. During a walk or run as shown in FIG. 14, the basic sole 18 together with the added insert 17 would alternately flatten or straighten and return toward its original shape as the heel of the sole 19 follows the rising heel 16 of the foot.

Figure 16A:
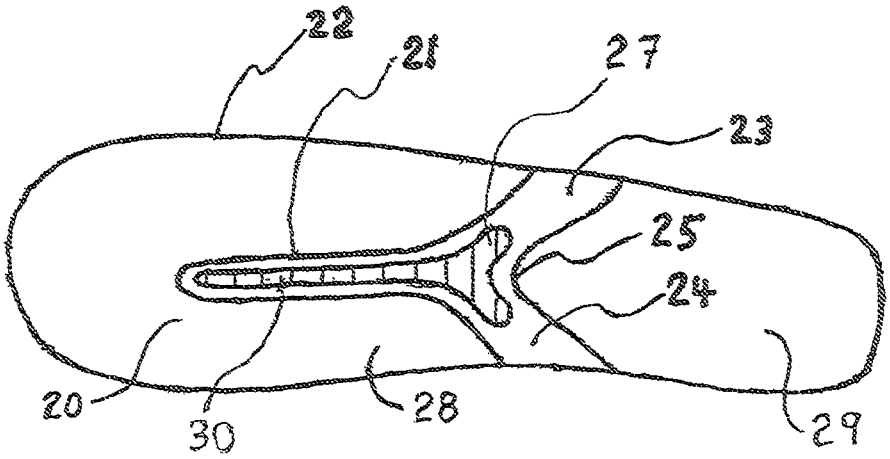
FIG. 16A is a top view of another embodiment of the present invention showing a sandal or flip-flop having a sole 22, a thong 21 with thong straps 23 and 24, a forking junction 25 and a curved, shaped or angled resilient insert 30, with a forked terminus and end tabs 27. Also indicated is the fore portion 20, mid section 28 and heel section 29 of the sole.
Figure 16B:
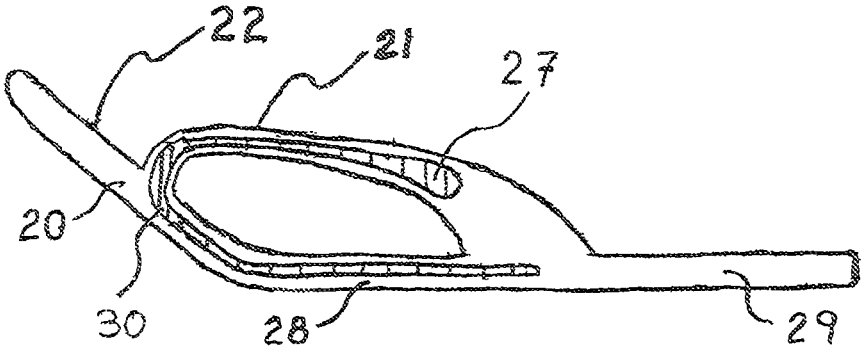
FIG. 16B is a cross-sectional, side elevation view of an embodiment of the present invention depicted in FIG. 16A, showing the sole 22, the thong 21 and the curved, somewhat "C-shaped" and angled, resilient insert 30, with a forked terminus and end tabs 27. Also indicated is the fore portion 20, mid section 28 and heel section 29 of the sole 22.

Another embodiment of the present invention, incorporating a somewhat "C-shaped," resilient and angled insert, is depicted in FIGS. 16A and 16B. The insert 30, somewhat like a rib, is formed as a continuous piece, preferably starting in the mid-section 28 or heel section 29 and angling or bending up into the fore portion 20 of the sole 22 and entering the thong 21 at the thong's forward point of attachment to the sole 22, then curving within the thong, along the top of the foot where it may fork with the thong at the junction 25, the location where the division of the thong straps, 23 and 24, begins. In some embodiments the insert may end at any point along the top portion of the foot or at the forking junction 25. In other embodiments it may divide and continue to any desired termination point within the straps as the straps descend to the points to which they attach, close to, or at the sides of the sole. FIG. 16A shows a top, cutaway view of the sole 22, thong 21 and insert 30 with end tabs 27. An advantage of this embodiment is that the insert and tabs can essentially grip or hold the foot and its angled segment can flatten or straighten as foot pressure is exerted upon the fore and aft portions of the sole and flex back toward its natural angle or shape to provide the necessary or an additional moment to rotate the heel of the sandal or flip-flop with the heel of the foot as the heel of the foot rotates off the ground when walking or running. If the sole itself is not sufficiently angled or resilient, the insert can also provide part or all of the necessary angle and resilience.

Figure 17A:
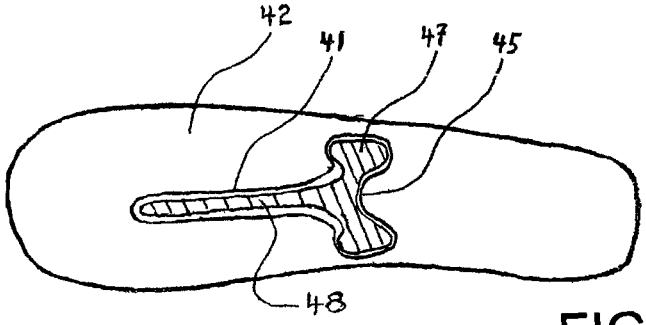
FIG. 17A is a top view of another embodiment of the present invention showing a sandal or flip-flop having a sole 42, a thong 41 without thong straps, a forking junction 45 and a curved, somewhat "C-shaped" or similar shaped and angled resilient insert 48. Also shown is a finger-like or tab-like gripping or holding terminus or tab 47.
Figure 17B:
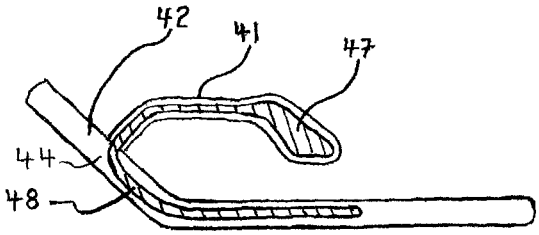
FIG. 17B is a cross-sectional, side elevation view of an embodiment of the present invention depicted in FIG. 17A, showing the sole 42, the thong 41 and the curved, somewhat "C-shaped" shaped and angled resilient insert 48, having an finger-like or tab-like gripping or holding terminus or tab 47. Here, the embodiment is shown in its natural shape or uncompressed shape.
Figure 17C:
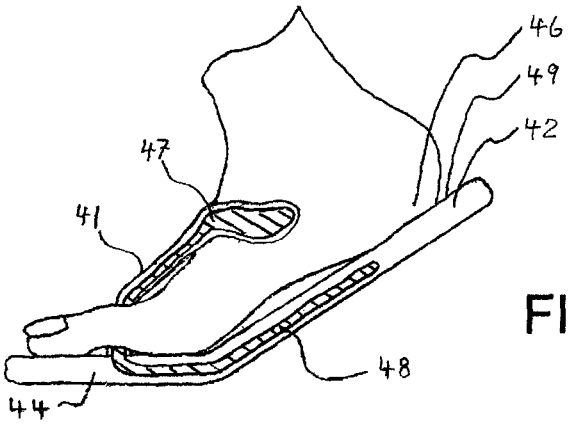
FIG. 17C is a side elevation view of an embodiment of the present invention as depicted in FIGS. 17A and 17B, but shown here in use on the trailing foot during a walk. As the fore portion 44 of sole 42 is held down by the forefoot, the heel of the sole 49 of the sandal is shown rising with the heel of the foot 46 as it tends to return to the natural shape and opening of the insert, shown above in FIG. 17B.

Another embodiment of the present invention, also incorporating a somewhat C-shaped insert, is depicted in FIGS. 17A, 17B and 17C. Here, the "C-shaped" insert contributes angularity and resilience to the sole and acts as a gripping member. This somewhat C-shaped, resilient and angled gripping member, could be made or formed as a continuous piece, with a first portion 48 substantially within the mid-section or heel section of the sole of the footwear, traveling to and angling up within the fore portion, or fore-sole, and a second portion 41 moving to and rising between the wearer's first and second toes, and continuing along the top of the foot where it may terminate, or continue and fork with the thong and then terminate, or it may continue and extend somewhat further down and/or along the sides of the foot, in either case being positioned to grip or hold the foot to the sole of the footwear and ending without connecting to thong straps or the sides of the sole of the footwear. The end or terminus of the insert may also be made with finger-like terminus or end tabs 47 as shown, to aid in the hold or grip of the footwear on the foot.

For the designs of 12A-14 and 16A-17F, the insert or attachment can be made of flexible, resilient material and formed with an angle that conforms to the angled junction between the fore portion and the aft portion of the sole of the footwear. The flexible sole of the footwear can also be made of resilient material and angled comparable to the angle of the insert or attachment, or the sole could optionally be made without necessarily being resilient or angled itself but instead derive its resiliency and angular shape from the resilient and angled insert or attachment.

In the embodiments of FIGS. 16A-17F, the curvature or opening of the "C shaped" insert (as viewed from the side when the fore-sole portion is on the left) can be made, either more open or more closed, to provide options in fit, comfort and walking characteristics for a variety of users.

For the designs depicted in FIGS. 16A-17F it is also envisaged that the upper portion of the thong and/or the tabs, 27, 47 and/or 47B, at the ends of the thong may be made to be adjustable for fit and comfort. For example, the elements of these sections may be made of material that is capable of being deformed beyond its elastic limit and retaining its new shape or set, under normal use.

Figure 17D:
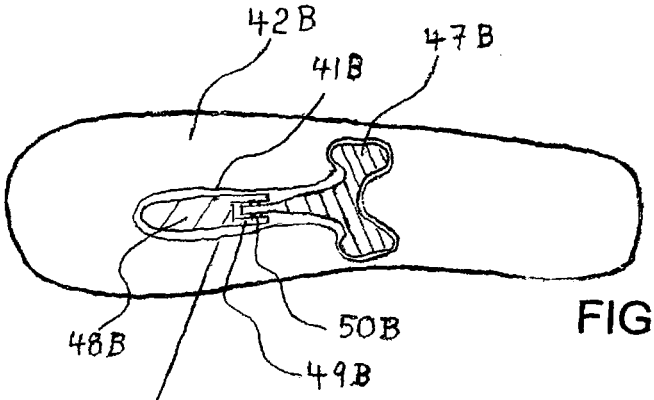
FIG. 17D is a top view of another embodiment of the present invention showing a sandal or flip-flop having a sole 42B, a thong 41B without thong straps and a curved, somewhat "C-shaped" or similar shaped and angled resilient insert 48B with its upper extremity made with a hinged end. In this example the hinge is shown as a clevis 49B, which is a "U-shaped" opening through which a clevis pin 50B is inserted to provide the axis for the hinge. Also shown is a finger-like or tab-like gripping or holding terminus or tab 47B having an end which mates with the clevis pin and enables terminus (or tab) 47B to rotate about the clevis pin 50B. In this embodiment it is intended to spring-load the terminus (or tab) about the axis of the clevis pin such that the spring will provide a holding pressure upon the top of a wearer's foot. For example a torsion spring (not shown) could be utilized. Other spring-loaded hinging mechanisms are known in the art and are envisaged.
Figure 17E:
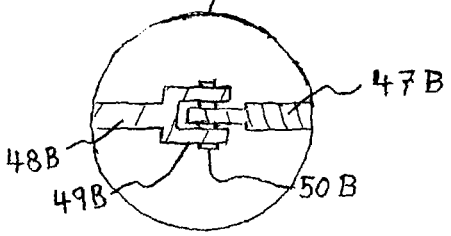
FIG. 17E is an enlarged view of the clevis arrangement shown in FIG. 17D.
Figure 17F:
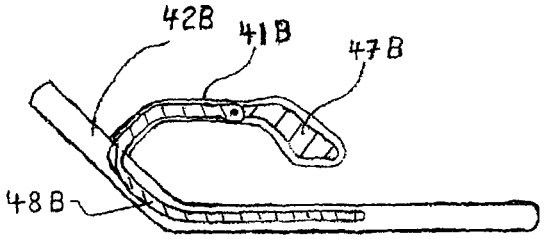
FIG. 17F is a cross-sectional, side elevation view of the embodiment depicted in FIG. 17D, showing the sole 42B, the thong 41B and the curved, somewhat "C-shaped" and angled, resilient insert 48B. Also depicted is the rotatable, spring-loaded terminus or tab 47B.

Another embodiment of the present invention is also envisaged as shown in FIGS. 17D-17F wherein the end of the insert 48B could be pivoted and spring-loaded, for example, at a location somewhat before or forward of the junction point and as depicted in FIGS. 17D-17F by the clevis 49B and clevis pin 50B. In this arrangement, a hole in the end of the separate tab-like terminus or end 47B would receive or engage the clevis pin enabling it to rotate about the pin such that with a spring load it may readily hold and adjust for movements of the foot. The rotating terminus or end tab could also have an open position for entry and a closed position for use.

It is also envisaged that the thong and/or the end tabs may be made wider along the top and/or the sides of the foot to provide more surface area for improved holding and/or comfort.

A variation of the embodiments depicted in FIGS. 16A-17C is also envisaged wherein the somewhat C-shaped insert could be modified for anchoring only in the fore portion of the sole. In such a case the insert would not be angled and could not provide the desired angle for the sole. Therefore, the angularity must be provided by the basic sole itself, made with sufficient resiliency and to the necessary angled shape or form to cause the sole of the footwear to function as intended, that is, flatten or straighten when pressure is applied simultaneously on the fore and aft portions of the sole by the foot and flex back toward its natural angle following the heel of the foot as the heel rises during walking or running.

It is also envisaged that somewhat C-shaped inserts similar, for example, to those depicted in FIGS. 16A-17C herein, which could be made without an angle for conventional flat-soled footwear such as sandals, flip-flops and the like. In such case they would grip or hold the foot to the footwear but would not cause the heel of the footwear to angle up with the heel of the foot while walking.

As noted, the resilient angled sole may be provided in numerous ways. For example, in the embodiments disclosed herein the basic sole may itself be angled and sufficiently resilient. In other embodiments, the basic sole may be angled and somewhat resilient, with the remainder of the resiliency provided by an angled insert. In still other embodiments, the required resiliency is provided by a combination of the resiliency of an angled basic sole and the resiliency of an angled insert. Whatever the means, the preferred embodiments of the sole provide sufficient angularity and resiliency such that the sole of the footwear straightens or flattens when pressure is applied simultaneously on the fore and aft portions of the sole by the wearer's foot and flexes back toward its original shape causing the heel of the footwear to follow the heel of the foot as the heel of the foot rises up while walking.

Variations of the insert embodiments described herein are also envisaged wherein the insert can be omitted, and the entire footwear (e.g. sandal) including the sole and thong or other forefoot securing means, is made by molding it as one or more pieces having the shape, resiliency and other physical properties that had been supplied by the insert. This, of course is also true of the embodiments that were not originally intended to have an insert.

For any of the designs disclosed herein that utilize an angled, resilient insert, the use of an angled, resilient basic sole is optional but not required.

It is also envisaged that for any of the embodiments of the present invention, the foot-gripping or holding action and conformance of the footwear to the foot could be increased by incorporating a highly elastic section(s) in all or part of the thong and/or the thong straps. For example, the entire thong/strap combination or any portion thereof may be made of a stretchable, elastic material.

As another example, one design for the employment of this concept would he to use a relatively stiff forward section of the thong, leather, plastic or rubber for example, from the toes to the forking point. Thereafter, an elastic material could be used, as described above, for all or a portion of the thong straps, for example, from the fork 25 shown in FIG. 16A to the attachment points on either side of the sole. This could lend additional stretch and pull to aid in keeping the sole in intimate contact with the heel of the foot.

Figure 6A:
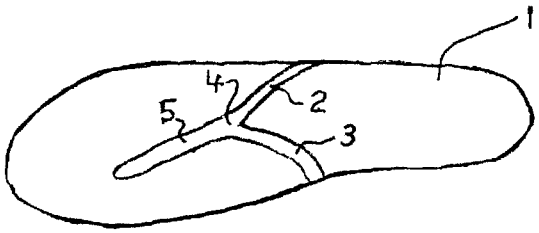
Prior Art FIG. 6A
FIG. 6A is a top view of a typical prior art conventional sandal or flip-flop, not in use, showing a sole and a thong, which branches into or connects to thong straps.
Figure 6B:
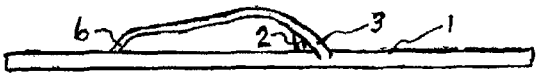
Prior Art FIG. 6B
FIG. 6B is a side view of the typical prior art conventional sandal or flip-flop also shown in FIG. 6A, not in use, depicting a sole and a thong which branches into or connects to thong straps.
Figure 7:
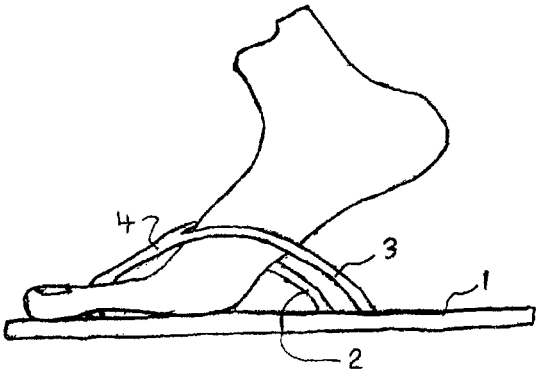
Prior Art FIG. 7
FIG. 7 is a side view of the typical conventional sandal or flip-flop of FIGS. 6A and 6B, in use, showing a trailing foot angling up and separating from the sole of the sandal during a walk.
Figure 8A:
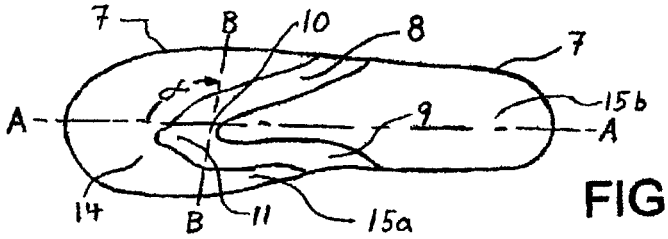
FIG. 8A is a top view of an embodiment of the present invention that is not in use. This view indicates the approximate horizontal direction of the axis BB of the bend or angle in the sole of the footwear that substantially parallels the axis along which a person's forefoot normally hinges relative to the remainder of the foot. The axis BB of the bend in the sole lies in a horizontal plane and is referenced by angle $\alpha$ which would normally be somewhat more than 90 degrees from a vertical, longitudinal, fore and aft, mid-plane A-A passing through the sole of the footwear. This axis also approximates the border between the fore portion 14 of the sole, or fore-sole, of the footwear and the remaining portion (or aft portion) of the footwear. As referenced herein, said remaining or aft portion is comprised of a heel section 15*b* of the sole 7 and a mid-section 15*a* of the sole 7, the mid-section residing between the heel section 15*b* and the fore portion 14 of the sole 7.
Figure 8B:
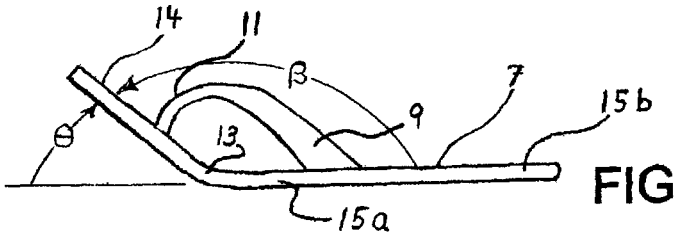
FIG. 8B is a side elevation view of an embodiment of the present invention that is not in use and shown also in FIG. 8A. This view shows a significant angle of incline $\theta$ of the front or fore-portion of the sole, rising from the horizontal plane of the remaining or aft portion of the sole 7, at a location 13 approximately where the sole hinges along an axis BB at a position close to and substantially parallel to the location where a person's forefoot normally hinges relative to the remaining portion of the foot. The angle $\theta$ is the complimentary angle to the obtuse angle $\beta$. Angle $\beta$ represents the upward obtuse angle subtended by the top surface of the fore portion of the sole and the top surface of the aft portion of the sole. Also shown in this view and in FIG. 8A is a thong 11 which is attached at its forward end to the fore-portion 14 of sole 7. From there, the thong travels up to a forking junction 10 where it divides into or attaches to two thong straps 8 and 9, each of which travel to opposite sides of the sole where they are attached at or near the edge of the sole somewhat toward the rear of the mid-section 15*a* of the sole 7 and/or near the front of the heel section 15*b* of the sole 7.

It is also envisaged that, depending upon the specific style or desired design, the foot-gripping or walking comfort could be improved by changing the point at which conventional thongs typically fork. Conventional thongs, as depicted in FIGS. 6A and 6B, usually fork immediately upon emergence from the toes. A further improvement is contemplated that would establish the point at which the thong forks on the upper portion of the foot to a position as far up and back toward the upward curve of the ankle as possible. As an additional option, the lower attachment points of the thong straps to the sole could be moved back further toward or into the heel section of the footwear. This would provide a better angle for the thong strap to exert the pull on the heel section of the sole. It is understood that the aforementioned embodiments can be utilized individually or in any combination with each other.

Another embodiment of the present invention is also envisaged that incorporates a resilient angled sole for golf footwear such as golf sandals, golf "flip-flops" and the like. For example, this could be provided by adding golf cleats or spikes to the bottom of a relatively thick and durable sole of the open top thong designs depicted in FIGS. 8A-17C.

Figure 18A:
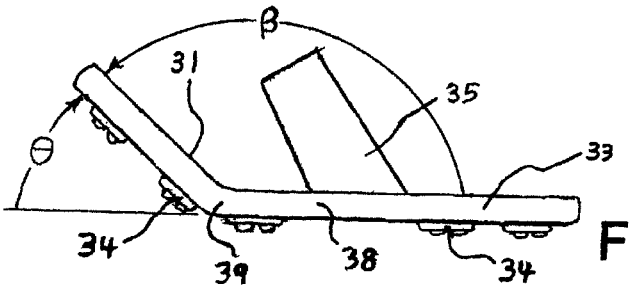
FIG. 18A is a side elevation view of an embodiment of the present invention that is not in use and thus is in its natural, uncompressed shape. This view shows a significant angle of incline θ of the fore portion 31 of sole 33, angling up or rising from the plane of the horizontal, remaining or aft portion of the sole 38, at a location 39, close to and substantially parallel to the axis of the location where a person's forefoot normally hinges relative to the remaining portion of the foot. Also shown is the obtuse angle β, the complimentary angle to angle θ. Angle β represents the upwardly open obtuse angle subtended by the top surface of the fore portion of the sole and the top surface of the aft portion of the sole. This figure also depicts a mid-sole foot band 35 and cleats 34 attached to the bottom of the sole 33.
Figure 18B:
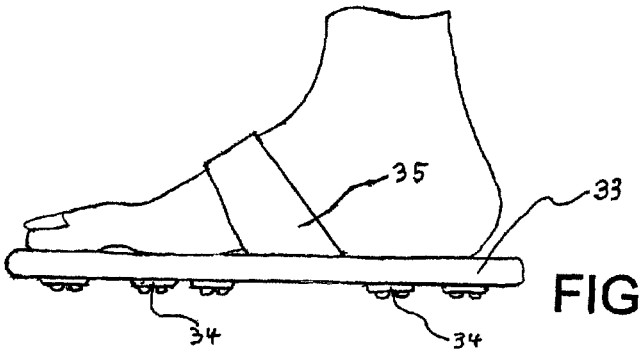
FIG. 18B is a side elevation view of the embodiment of the present invention depicted in FIG. 18A and in FIG. 18C. Here, it is shown in use, and essentially straightened or flattened by the pressure or force exerted by the wearer's foot. The figure also depicts cleats 34 attached to the bottom of the sole 33.
Figure 18C:
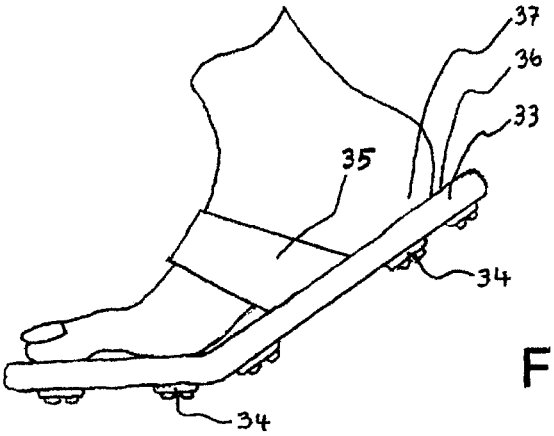
FIG. 18C is a side elevation view of the embodiment of the present invention depicted in FIGS. 18A and 18B. Here, it is shown in use on the trailing foot during a walk. As the fore portion 31 of the sole 33 is held down by the forefoot, and the heel of the foot relieves pressure on the aft portion of the sole, the heel of the sole 36 of the sandal is shown rising with the heel of the foot 37 as the sole tends to return to its natural angle shown above in FIG. 18A. The figure also depicts cleats 34 attached to the bottom of the sole 33.

The golf sandals could also be made with angled, flexible and resilient soles having a thong or, as an alternative for example, with an upper foot attaching band 35 in the mid-section of the sandal having an open toe, as depicted in FIGS. 18A-18C. For additional toe protection, an open-toe or a completely closed-toe fore portion covering of the sandal could be provided. Further, such a design could work with other known designs, for example, as a provision for golfers that may prefer additional fastening of the foot to the sole of the footwear, heel straps or upper heel coverings could be incorporated. Heel straps or coverings would, however, preclude the convenience of "slip-on" entry.

Further, the angled sole of the sandal, as depicted in FIGS. 18A-18C, could be made, not only of flexible and resilient material but also of a moldable, durable material in order to either mold the cleats 34 as part of the sole or the cleats could be made separately and affixed to the sole of the footwear in a subsequent assembly. The sole 33 could also be molded as one piece or molded with a flexible, resilient and angled insert or a slot for an insert as described previously herein. The number and location of the cleats 34 would be at the option of the footwear designer. The mid-sole foot band 35 could be provided as a single piece, wrapping over the foot and attached at each end to either side of the sole 33 or it could be made in two pieces connectable at the top of the foot by hook and loop (Velcro) material or comparable connecting device. It is contemplated that other prior art foot fastenings may also be used in conjunction with the various embodiments of the present invention.

It is contemplated that the embodiments disclosed herein may be made by various methods of manufacturing. As one example, a method of manufacturing casual footwear would include the steps of (1) selecting a flat mat-like flexible and resilient material, (2) cutting said material into the shape of a casual footwear sole having a top surface, a fore portion, and an aft portion, (3) deforming the sole such that said top surface of said fore portion of the sole forms and retains an obtuse angle relative to the top surface of said aft portion of the sole, and (4) attaching to the sole a means for securing the forefoot of the wearer's foot to the fore portion of the sole. This method could further include forming the obtuse angle to an angle of less than about 150 degrees, preferably to an angle of about 135 degrees. In this method, the deformation step could further include applying pressure to said sole, and it could also include the application of heat. In this method, the step of providing a slot in said sole could be added such that sole was adapted for the inclusion of an insert. As a further step this method could include the step of placing a substantially resilient insert having an initial shape into said slot.

Several methods of manufacturing the footwear embodiments presented herein are envisaged. For example, for the construction of a basic sole, a flat mat-like flexible and resilient material, such as rubber or plastic, can be cut into the shape of a casual footwear sole having a top surface, a fore portion, and an aft portion. Thereafter, the sole could be deformed such that said top surface of said fore portion of said sole forms and retains an obtuse angle relative to the top surface of said aft portion of said sole. When the sole is cut to shape and formed as described above, a means for securing the forefoot of the wearer's foot to the fore portion of the sole can be attached to the sole. It is preferred that said obtuse angle would be about 150 degrees or less, most preferably about 135 degrees.

The obtuse angle could be formed by applying force or pressure by any of various conventional means. This process could also be accompanied by the application of heat controlled according to considerations of the physical properties of the selected material Inserts and attachments, such as depicted in FIGS. 11A-15E, could be cut or machined out of a flexible and resilient material, such as metal, rubber or plastic, to the desired pattern and thereafter deformed into the desired angle with force or pressure applied by mechanical means. The shaped and resilient insert would then be put into the sole. To facilitate the installation of the insert into the sole, a slot can be provided in said sole that is adapted to aid in the inclusion of the insert.

It is understood that other manufacturing methods or sequences could be employed to achieve a similar result or product. For example, a flat resilient insert could be inserted into a flat flexible sole and, in a subsequent operation, the composite flat sole could be deformed or shaped into a composite angled sole. In this case only the insert would contribute the desired angular shape and resiliency.

Other methods of manufacturing casual footwear according to the designs of the embodiments presented herein bear consideration. For example, for the construction of the basic sole, a flat mat-like flexible and resilient material having a top surface could be selected. The resilient material could be deformed so that the top surface of a first portion of said material is angled at an obtuse angle relative to the top surface of said remaining portions. Thereafter, individual soles could be cut out of the angled material into the shape of a casual footwear sole having a top surface, a fore portion, and an aft portion. Thence, a means for securing the forefoot of the wearer's foot to the fore portion of the sole can be attached to the sole. It is preferred that said obtuse angle would be about 150 degrees or less, most preferably about 135 degrees.

Still other methods of manufacturing are envisaged. For example, a sole-making mold could be constructed and configured to form a casual footwear sole comprising a fore portion and an aft portion, and having an initial shape where said fore portion is upwardly inclined relative to the horizontal plane of said aft portion. A hot viscous material could be injected into said mold such that when cooled the material would be substantially flexible and resilient. The material would be ejected from the mold after cooling and a means for securing the forefoot of the wearer's foot to the fore portion of the sole would then be attached to the sole.

Still other methods of manufacturing casual footwear according to the designs of the embodiments presented herein are considered. For example, a sole-making mold could be constructed and configured to form a casual footwear sole comprising a fore portion and an aft portion, and having an initial shape where said fore portion is upwardly inclined relative to the horizontal plane of said aft portion and also including a means for securing the forefoot of the wearer's foot to the fore portion of the sole. A hot viscous material could be injected into said mold such that, when cooled, the material is substantially flexible and resilient. The material would be ejected from the mold after cooling.

A method of manufacturing a casual footwear sole could be employed wherein the sole of the flexible casual footwear would be made with a slot. A substantially resilient insert member having a fore portion, an aft portion, and an initial shape wherein said fore portion is angled relative to said aft portion would also be made and said substantially resilient insert member would be inserted into said slot in order to cause the fore portion of the sole to have an upward bend relative to the remaining portion of said sole.

It should be mentioned that the sole itself without the insert may or may not be made resilient and angled or curved. If the sole itself is not resilient and angled, all of the resiliency and angularity would be provided by the insert.

Also envisaged is a method of manufacturing a gripping member, for example, as depicted in FIGS. 16A-17C, which is adapted for use in footwear such as a sandal wherein a mold would be constructed which is adapted to form a substantially "c-shaped" member comprising a substantially elongated sole-insert portion adapted to be inserted into the sole of the sandal and a thong-portion of said member disposed at an angle of approximately 90 degrees from said substantially elongated sole-insert portion, wherein said thong portion is adapted to protrude out the top of the sole of the sandal and be disposed in between the first and second toes of the wearer and a continuing top portion of said member disposed above the substantially elongated sole-insert portion and adapted to form a foot-insert pocket or receptacle for the wearer's foot. To produce said member, a hot viscous material such as metal, plastic or rubber would be injected into said mold which, when cooled, would be substantially flexible and resilient, after the material was cooled, the material would be ejected from the mold. As discussed earlier, the finished gripping member could be made of a material and dimensioned to allow convenient deformation of upper terminus or ends to allow some adjustment for improved conformance to the wearer's foot.

The gripping member, as shown assembled in FIGS. 17D-17F, could also be made in a similar manner as the aforementioned gripping member, but molded in two separate pieces, each having a complimentary clevis hinge joint. The two pieces would be joined with a clevis pin after being ejected from the mold(s) and a torsion spring, for example one similar to those used in clothes pins and mouse traps, could be added to provide additional gripping bias to hold the footwear to the foot when worn. The insert could then be inserted (or attached) to the sole.

Another method of making or manufacturing a gripping member would be to stamp or cut the appropriate pattern or shape out of material, for example such as metal, plastic or rubber and, in a subsequent operation, form the cutting or stamping using a mandrel or other forming tool(s) suitable to form the piece into the desired final shape of the gripping insert.

Many other conventional techniques can be used to form, mold or fabricate metal, plastic and/or rubber parts. Note that more than one material may be used in the manufacture of the embodiments of this invention, many of which may be suitable to form the constituent parts of the final product.

A number of embodiments and manufacturing methods have been described. Nevertheless, it will be understood that various modifications may be made without departing from the spirit and scope of the invention. For example, much of this document has been described, with respect to sandals and "flip flops," but other forms of footwear may also be addressed, such as slippers and athletic footwear. It will be further understood that still other modifications may be made without departing from the spirit and scope of the inventions described herein.

What is claimed is:

1. Footwear comprising:

a sole made of a resilient material;

a thong connected to said sole;

an insert-member made of metal, plastic, or rubber;

wherein said insert member is disposed substantially within the center of said sole;

wherein said insert-member is disposed such that it deforms said sole; such that when said footwear is not being worn by the user, said sole includes a fore portion upwardly inclined relative to the horizontal plane of an aft portion of said sole;

wherein said aft portion of the sole is thereby structured to maintain substantially continuous contact with the heel of the wearer's foot while walking;

wherein the footwear does not include any material designed to secure the user's heel to said aft portion of said sole.

2. The footwear of claim 1, wherein the footwear is sandals.

3. The footwear of claim 1, wherein the footwear is flip-flops.

4. The footwear of claim 1, wherein the footwear is slippers.

5. The footwear of claim 1, wherein a fore portion of said sole is upwardly inclined at an angle of more than about 30 degrees and less than about 90 degrees when the footwear is not being worn by the user.

6. The footwear of claim 5, wherein a fore portion of said sole is upwardly inclined at an angle of about 45 degrees when the footwear is not being worn by the user.

7. The footwear of claim 6, wherein said sole is made of a single-piece of resilient material.

* * * * *